US006685575B1

(12) United States Patent
Anderson

(10) Patent No.: US 6,685,575 B1
(45) Date of Patent: Feb. 3, 2004

(54) PORTABLE AUTOMATIC GOLF BALL TEEING DEVICE

(76) Inventor: James H. Anderson, 17 Portsmouth St., Cambridge, MA (US) 02141

( * ) Notice: Subject to any disclaimer, the term of this patent is extended or adjusted under 35 U.S.C. 154(b) by 0 days.

(21) Appl. No.: 10/272,782

(22) Filed: Oct. 17, 2002

Related U.S. Application Data

(60) Provisional application No. 60/342,920, filed on Oct. 19, 2001.

(51) Int. Cl.[7] ..... A63B 69/36
(52) U.S. Cl. ..... 473/136; 473/137
(58) Field of Search ..... 473/132–137

(56) References Cited

U.S. PATENT DOCUMENTS 2,071,356 A * 2/1937 Pagett ..... 473/137
2,675,237 A * 4/1954 Willcox ..... 473/136
4,360,204 A * 11/1982 Karr ..... 473/137
5,282,628 A * 2/1994 Komori et al. ..... 473/136
5,529,307 A * 6/1996 Chang ..... 473/136
6,106,407 A * 8/2000 Peyton, Jr. ..... 473/225
6,585,603 B2 * 7/2003 Montalvo ..... 473/136

* cited by examiner

*Primary Examiner*—Steven Wong
(74) *Attorney, Agent, or Firm*—William Nitkin

(57) ABSTRACT

A portable device capable of placing a golf ball on a tee repeatedly without the interaction of the user. The device consists of a base, a ball storage hopper, a ball scoop leading to an arm, a control system including a control panel, a rechargeable battery, an artificial turf mat with a rubber tee, a handle and wheels, and a housing to enclose the device. The user loads golf balls into the storage hopper where they roll down a track to the ball scoop. A sensor signals when a new ball is needed, and a motor lowers the arm which is connected to the ball scoop. When the arm is at its lowest position the ball rolls down the arm to the tee. When the ball is hit off the tee, a new ball is automatically placed on the tee.

5 Claims, 5 Drawing Sheets

PORTABLE AUTOMATIC GOLF BALL TEEING DEVICE

This application claims the benifit of Provisional application No. 60/342,920, filed Oct. 19, 2001.

BACKGROUND OF THE INVENTION

Field of the Invention

This invention resides in the field of the sport of golf, and more particularly relates to a device for the act of training for, and practicing hitting a golf ball with a golf club, the device being a portable and automatic teeing device which automatically puts a golf ball on a tee.

DESCRIPTION OF PRIOR ART

In order to improve their games, many golfers are keen on practicing their strokes at driving ranges or other settings besides an actual golf course. In either case there are several aspects of a golfer's game that become necessary to practice. The first, and most obvious, aspect is the swing, which encompasses the back swing, follow-through, and the motion of the arms and club during the swing. The second aspect is the interaction between the golfer and the club, or more commonly called, the grip. This aspect includes the position of the hands on the club, the spacing and interaction of both hands, and the tightness of the grip on the club. The final aspect is the stance of the golfer. The stance includes the distance between the ball and the golfer, the spacing and position of the feet, the bend of the knees, the posture of the upper body, and finally the position of the head.

With so many variables to keep in mind, the golfer must hold some variables constant to focus on ones which are problematic. However, in the act of practicing, the golfer is usually unable to keep any variables constant because of the need to constantly bend over and put a new ball on the tee. When being taught by a golf instructor, the pupil is better able to concentrate on the fine points of the swing, stance, and grip because the instructor puts the ball on the tee each time.

The prior art in this field is very diverse, but it can divided into two general categories: mechanically operated and electrically operated machines.

The mechanically operated machines tend to be much less expensive than the electric machines, but the mechanical machines are rarely fully automatic because they require the golfer to exert some extra motion to tee the next ball. For example U.S. Pat. No. 5,820,475 to Luna (1998) and U.S. Pat. No. 5,582,325 to Janier (1996) both depend on an additional motion from the golfer to tee the next ball. Moreover, the mechanical devices are usually not as reliable because they require so many moving parts connected by many links, and if one part is broken, stuck, rusted, etc., the entire machine will cease to operate. For example, U.S. Pat. No. 5,464,223 to Dermott (1995) and U.S. Pat. No. 4,602,789 to Chung (1986), both designs have many moving parts connected by gears, levers, and links. Additionally the mechanical machines tend to be less consistent, and it is not uncommon for two or more balls to be released from the machine at the same time. This inconsistency is due to the different input forces and movements made by the user. For instance if the golfer holds the lever or pedal down too long, more balls will be released.

The electrically operated machines are generally more reliable because they consist of very few moving parts along with some circuitry and sensors. However, they tend to be more expensive than the mechanical machines. Electrical machines also tend to be less portable, because their methods of sensing the ball on the tee usually require some hardware around or under the tee. Besides the presence of the hardware, there is also the matter of protecting the expensive hardware from errant swings. Therefore, the sensors, which can be optical, pressure, or magnetic, are usually located underneath the tee, protected by a platform on which the golfer stands. For this reason the electrical machines are frequently permanently installed. For example in U.S. Pat. No. 5,662,526 to Sutherlin (1997) there is a pneumatic piston located beneath the tee. In U.S. Pat. No. 5,351,964 to Kruger (1994) and U.S. Pat. No. 5,078,401 to Fehrenbach (1992) the apparatus extends a significant distance into the ground, making them non-portable.

There are several patents, however, which share the same goals as this invention. In U.S. Pat. No. 4,981,299 to Petrillo, there is a photosensor located in the rubber tee to determine whether a new ball is needed. It also calls for a ball delivery arm to be driven by a motor. Each new ball is placed in the end of the arm, requiring the arm to travel 180 degrees to get the ball to the tee.

Two other patents of the prior art have similar designs, especially regarding the control system. U.S. Pat. No. 6,375,580 to Schmidt, et al, and U.S. Pat. No. 5,895,325 to Tomey both use sensors of different types to determine whether or not a ball is on the tee and have different ways of delivering the ball to the tee. These devices utilize a sliding arm that moves in and out of the machine on a linear path. Since the ball is on the arm in the same linear path, there needs to be some other motion to get the ball down to the tee. In U.S. Pat. No. 6,375,580 the entire arm is connected to the motor with a linkage system which drops the arm slightly after extending to the tee. This drop in the arm leaves the ball on the tee while the arm goes back to the machine. In U.S. Pat. No. 5,895,325 the arm brings the ball directly over the tee, and then a spring-controlled release mechanism on the end of the arm allows the ball to drop into place on the tee.

SUMMARY OF THE INVENTION

The device of this invention consists of a base, a ball storage unit or hopper, a ball scoop leading to a ball delivery arm, a control system, an artificial turf mat along with a rubber tee, a handle, two wheels, and an outer housing to enclose the entire device.

In one embodiment the device is electrically operated and it gets its power from a rechargeable battery. Its means for sensing a golf ball's presence on the tee is a sensor mounted on the device. The sensor senses a reflection from the ball, and when the ball is gone, the sensor sends a signal for the device to put a new ball on the tee. In using this embodiment there are no special tees or sensors under the tee. Therefore a golfer can set up the device at a driving range and use the mat and tee provided by the range, but when the golfer is at home, the device can also use the mat and tee that come with the device.

In a second embodiment an alternative means for sensing a golf ball's presence on the tee is used which is a photoelectric sensor located inside the rubber tee. The tee used in this embodiment is a standard driving range rubber tee, as opposed to other inventions that use special tees which connect to other apparatus or sensors below the ground. By placing the sensor in the tee, however, it becomes susceptible to damage from the repeated blows from the golf club. This problem is solved by surrounding the sensor with a clear epoxy to cushion the blows from the club. When the tee finally fatigues, as all rubber tees do, it is very simple and inexpensive to replace the tee and sensor. Since there are no connections or sensors beneath the tee, the golfer gets to stand on the same plane as the bottom of the tee, instead of hitting from a tee that is sitting an inch above the ground.

In another embodiment, the device can have its own artificial turf mat attached to the bottom of the device. With this mat the golfer can use the device on any relatively level surface—not just grass. The mat, however, as discussed above, can be detachable so that the device could be used at a driving range where an artificial turf mat already exists.

The only part of the device that moves is the ball delivery arm and the scoop, which are connected by a snap fit so that if the arm is hit by the golfer, it will break away from the scoop. The scoop is designed so that only one ball can be in it at a time and once it has picked a ball, it blocks the rest of the balls in the ball track so that no more balls can come out.

The arm operates by depositing the ball at one end and having it roll down to the other end of the arm during the 90 degree path of travel of the arm, ending up at the tee. The advantage of this new design is that the counter-weighting of the arm by the ball receipt portion of the arm helps the arm return to its original state after delivering a ball to the tee. Since the counter weight helps pull the arm back up, the motor is spared some work and therefore the battery lasts longer. One further benefit of my design is that the depth of the device in my design can be much smaller since it does not have to house the length of the arm in the depth dimension. In my design the arm stays in an upright position when it is not putting a ball on the tee. The depth of the device is very important in driving ranges because the spaces between the mats and their dividing walls are usually at a minimum. Additionally, the base of the device has two wheels at one end and a handle at the opposite end so that the entire device can be wheeled around in a similar motion to a suitcase with wheels. The advantage of the design of the present invention is that the arm is the only moving part instead of having several links moving in relation to each other or a spring-controlled gate in addition to the arm. A second advantage of the present invention over the sliding arm type machines of the prior art is that the depth of the device in my design can be much shorter for the same reasons stated previously.

DESCRIPTION OF THE PREFERRED EMBODIMENT(S)

Figure 1:
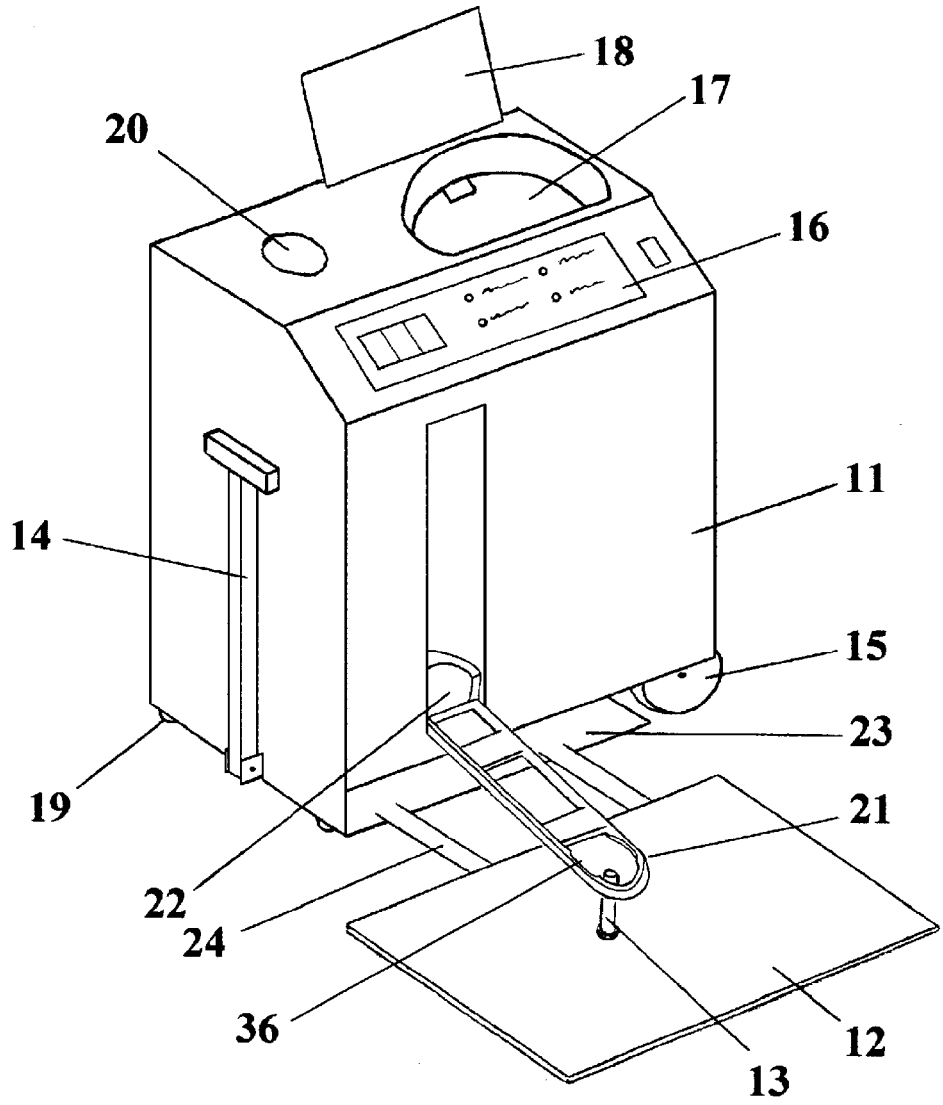
FIG. 1 illustrates a front perspective view of the portable, automatic golf ball

FIG. 1 illustrates a front perspective view of the device of this invention. The device is covered on all sides by the housing 11 except the bottom which consists of base 23. The base is supported by four feet 19 when sitting or by two wheels 15 when rolling. In rolling the device, the user lifts and pulls the device using handle 14. Arm 21 is shown in the down position so that a ball could roll from ball scoop 22 to the end of the arm where it drops through opening 36 onto tee 13. Tee 13 sits on the ground and extends upwards through a hole in turf mat 12. Turf mat 12 is connected to base 23 with straps 24 so that the positions of turf mat 12 and tee 13 remain constant. On the sloped section of the device between the front and top sides is control panel 16 which is the user interface of the device. Control panel 16 contains the power switch, digital ball counter, operating mode switch, a low ball warning light, a low battery warning light, and a button to lower the arm for alignment purposes. Also located on the top of the device are button 20 for the manual operation mode of the device, ball tray 17 and lid 18 to cover ball tray 17.

Figure 2:
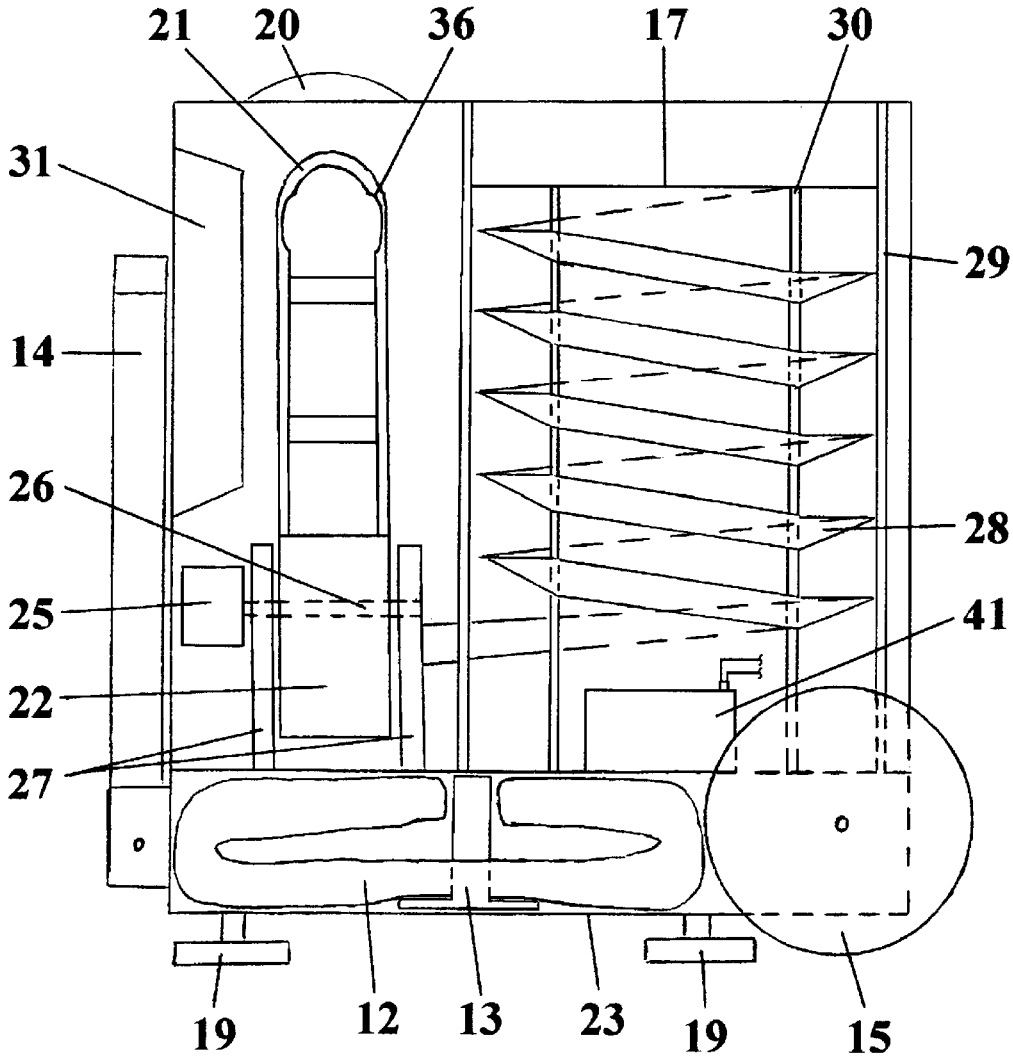
FIG. 2 illustrates a front cross-sectional view of the device with the arm in its

FIG. 2 illustrates a front cross-sectional view showing arm 21 in an upright position. In this representation turf mat 12 along with tee 13 are shown folded and stored above base 23. Above turf mat 12 is ball scoop 22 which is attached to arm 21. Ball scoop 22 is mounted to the device with scoop mounts 27 which are bolted to base 23. Motor 25 drives ball scoop 22 and arm 21 through shaft 26. Motor 25 is also mounted on scoop mounts 27. The electrical signals given to the motor come from the circuit board which is located in circuit board housing 31 on the inside of the side wall of housing 11. The golf balls 32 are placed into ball tray 17 at which point they roll down ball track 28. Ball track 28 has a helical shape and is fixed to inner hopper cylinder 30. Outer hopper cylinder 29 is concentric to inner hopper cylinder 30 and serves to keep golf balls 32 on ball track 28. Golf balls 32 roll into ball scoop 22 at the end of ball track 28. Battery 41 is seen at the bottom of inner hopper cylinder 30. The leads from the battery connect to the circuit board.

Figure 3:
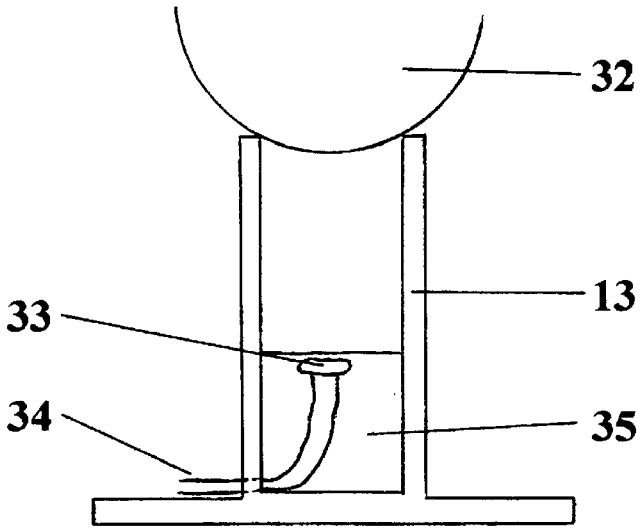
FIG. 3 illustrates a cross-sectional view of the rubber golf tee showing the light

FIG. 3 illustrates a cross sectional view of tee 13 with a golf ball 32 sitting on it. At the bottom of the hollow portion of tee 13 is a clear epoxy cushioning 35 which holds light sensor 33 in place as well as protecting it from club impact. Sensor leads 34 extend from light sensor 33 and exits tee 13 near its base where they eventually connect to the circuit board.

Figure 4A:
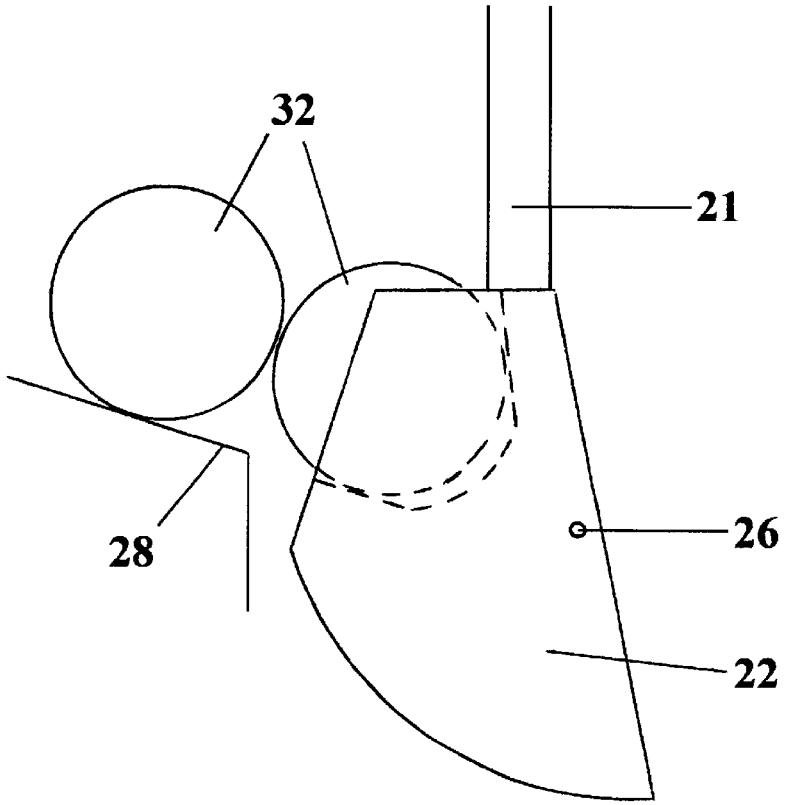
FIG. 4A illustrates a side view of the ball scoop and the arm in the upright position.
Figure 4B:
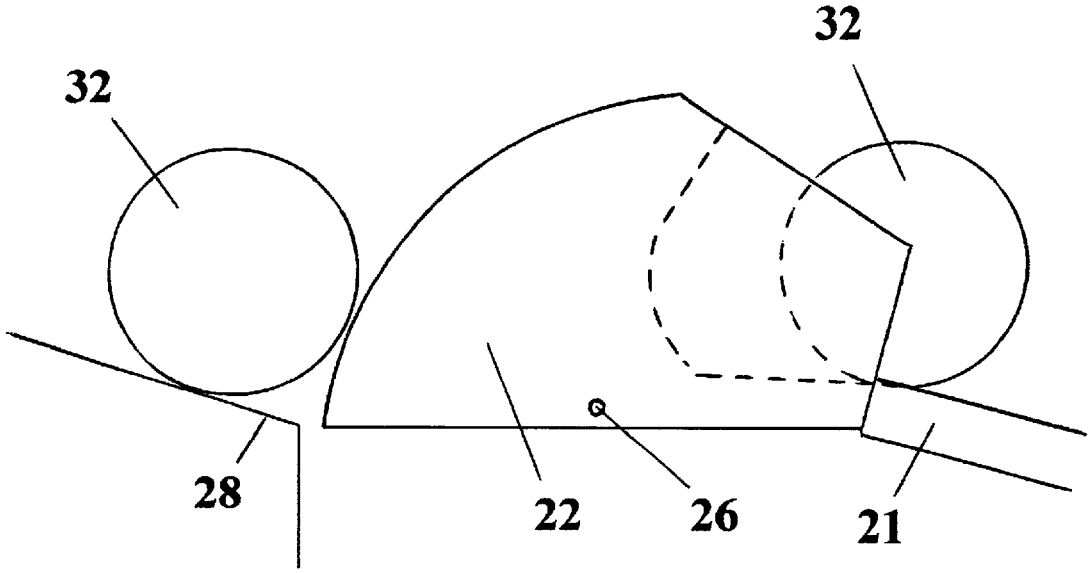
FIG. 4B illustrates a side view of the ball scoop and the arm in the down position.

FIGS. 4A and 4B illustrate side views of ball scoop 22 and arm 21 as well as showing the interface between ball track 28, scoop 22, and golf balls 32. FIG. 4A shows scoop 22 in its upright position so that a single golf ball is permitted to roll into scoop 22. FIG. 4B shows scoop 22 in its down position such that a golf ball 32 already in scoop 22 is permitted to roll down arm 21 towards tee 13. The curved side of the scoop 22 keeps the next golf ball 32*a* from progressing down ball track 28.

Figure 5:
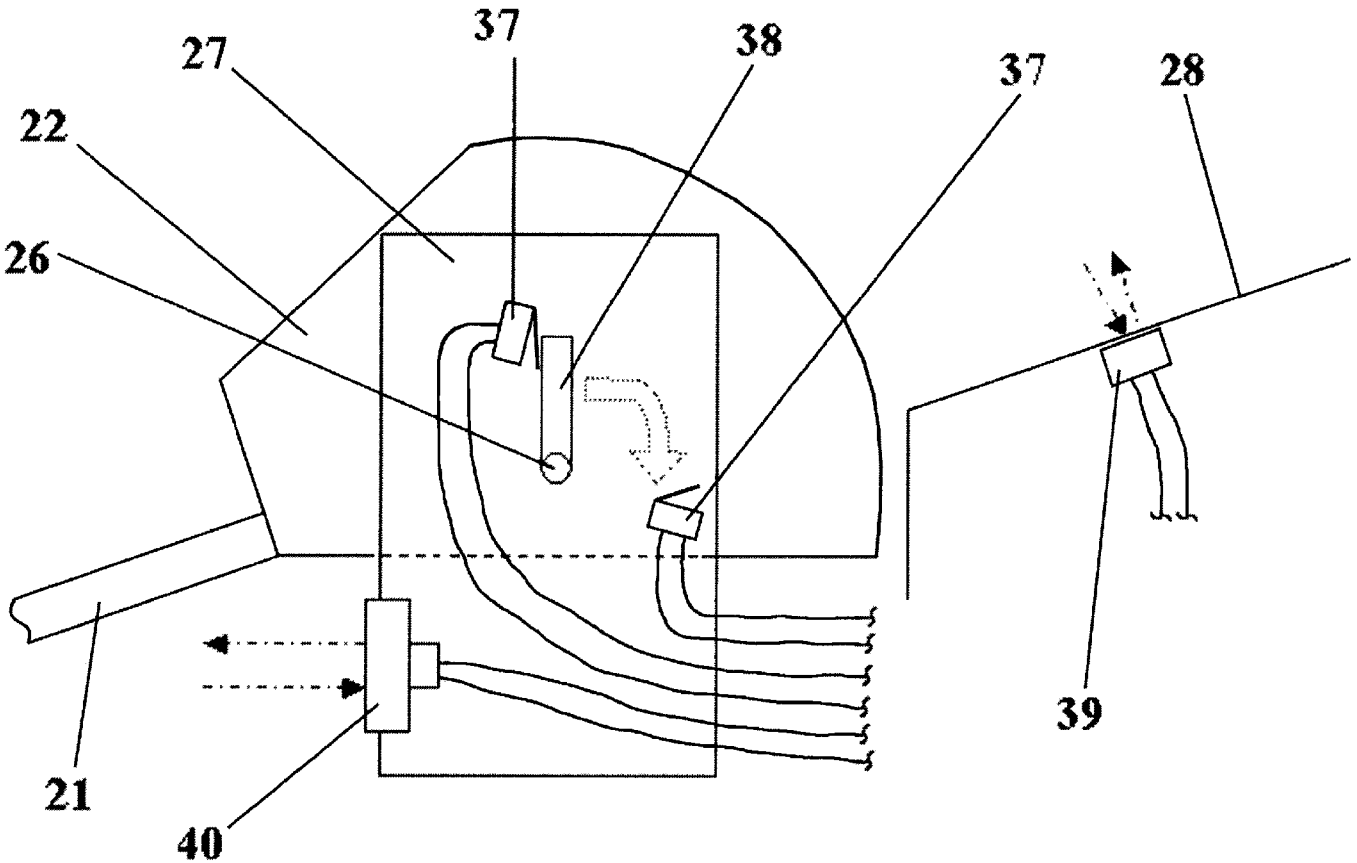
FIG. 5 illustrates a side view of the scoop mount and scoop with limit switches and sensors.

FIG. 5 shows the side of the scoop mount 27 along with the scoop 22. The end of shaft 26 is seen coming through scoop mount 27. Attached to the shaft is limit switch trigger arm 38 which rotates to an up position and a down position as shaft 26 turns. When scoop 22 reaches its up and down positions, trigger arm 38 engages limit switches 37 to stop motor 25 from turning. Also mounted on scoop mount 27 is ball sensor 40, which is aimed at tee 13 to see if there is a golf ball 32 in position. The end of ball track 28 is also shown in FIG. 5 with low ball sensor 39 mounted beneath it. This sensor checks to see that there are still golf balls 32 on ball track 28. Limit switches 37, ball sensor 40, and the low ball sensor 39 are all connected to the circuit board.

In the operation of the device, the user begins by lifting lid 18 at the top of the device and placing a plurality of golf balls 32 into ball tray 17. Golf balls 32 will enter through the hole in ball tray 17 whereupon they will roll down helical ball track 28. The user then removes turf mat 12 and tee 13 from the storage area in base 23 and unfolds the turf mat so that mat straps 24 are completely extended. With the turf mat in place, the vertical portion of tee 13 is placed in the hole in the turf mat. Alternatively, the device can be set up next to an already existing driving range mat and tee with the turf mat and tee left in the base storage area. Next, the user turns the device on by pressing the power switch, located on the control panel 16. If the device is being used with a driving range mat and tee instead of the included turf mat and tee, the user can press the arm down button on the control panel which lowers the arm to the tee. Once the arm is down, the user can move the device to align the arm with the tee. When the arm is properly aligned, the user presses a button on the device, and the arm goes back to its starting position.

With the power switched on and the device properly aligned, the user can choose an operating mode; either manual or automatic. In manual mode the user is required to press manual button 20 to have a golf ball 32 placed on tee 13. With the user in the golfing stance, a golf club can be used to press the manual button. Immediately motor 25 turns shaft 26 which lowers ball scoop 22 and arm 21 to the down position. Once in position a golf ball 32 is allowed to roll out of the scoop and down the arm towards tee 13. At the end of the arm, there is hole 36 just larger than a golf ball. When the ball reaches the end of the arm, it falls through the hole 36 on to the tee. With the golf ball securely on the tee, the motor moves the arm and scoop back to the upright position. As the scoop returns to the upright position, the next golf ball 32*a* is allowed to enter the scoop and all the balls on ball track 28 move down accordingly. This process is repeated when the golfer requires another ball.

In automatic mode the device places a new golf ball 32 on the tee 13 as soon as the previous ball leaves the tee. This process is started when the golfer presses the manual button 20 as described before. Once the first golf ball is removed from the tee, however, the golfer is not required to press the manual button again. The sensor mounted on the device senses when the ball is hit. The alternative embodiment is one in which light sensor 33, mounted inside the tee, is able to sense the difference between ambient light (no ball on the tee) and the darkness (ball on the tee). In each instance a signal is sent to the circuit board when the sensor senses that a ball is no longer on the tee, which, in turn, sends a signal to motor 25 to lower the next ball. This process will continue until the golfer switches the device to manual mode or the device runs out of balls.

The control system for this device deals with several inputs and several outputs, and it consists of the following elements: the control panel 16, the battery, the manual button 20, the ball sensor (or the light sensor 33 in the alternate embodiment), the motor 25, the circuit board, and the sensor to determine whether the supply of golf balls 32 is nearly depleted. The many functions of this system are as follows:

(a) The device switches modes at the touch of a button.

(b) The user is warned when the supply of golf balls is getting low.

(c) The user is warned when the battery needs to be recharged.

(d) A digital counter shows the number of balls hit by the user.

(e) The counter can be reset when a button is pressed.

(f) In manual mode a ball is placed on the tee when the user presses the manual button.

(g) In automatic mode a ball is placed on the tee when the previous ball is removed from the tee.

(h) In manual mode a new ball cannot be placed on the tee if a ball is already on the tee, even if the user presses the manual button.

(i) The motor stops when the arm reaches its down and upright positions.

(j) The user can push a button to have the arm go down and stop there so that the device can be aligned properly with the tee.

In an alternate embodiment tee 13 is placed through the hole in the turf mat 12, but it is not fixed in any way. If the user desires a tee of a different height, the tee can be removed from the turf very quickly and unplugged from the device. Then a new tee can be plugged in and placed into the hole in the turf. The same process is used if a tee were to break.

Although the present invention has been described with reference to particular embodiments, it will be apparent to those skilled in the art that variations and modifications can be substituted therefor without departing from the principles and spirit of the invention.

I claim:

1. A portable, self-contained automatic device for use by a user for placing a golf ball on a tee, comprising:

a housing having an opening defined therein, a base and first and second ends;

a ball storage unit disposed within said housing, said ball storage unit including means for entering balls within said ball storage unit and ball delivery means;

a mat attached to said base of said housing;

a tee disposed on said mat;

a control system including a power supply;

sensing means to sense the presence and absence of a ball on said tee, said sensing means connected to said control system;

a shaft mounted in said housing;

a ball delivery arm, said arm having a first end and a second end, said ball delivery arm pivotally mounted on said shaft and passing through said opening in said housing;

a motor attached to said shaft, said motor when operated by said control system, receiving power from said power supply to move said arm from a first upright position to a second down position, and vice versa;

a ball receipt portion defined in said second end of said arm, said ball receipt portion adapted to receive a ball from said ball delivery means when said arm is in said first upright position and said arm, when rotated by said shaft driven by said motor to its second down position, adapted to allow said ball to roll to said first end of said arm;

an opening defined in said first end of said arm, said opening being of a size to receive said ball;

said tee being disposed in said mat in a position under said opening in said arm at said first end thereof for deposit of said ball on said tee by said arm when in its second down position, said motor then driving said shaft to return said arm to its first upright position, leaving said ball on said tee where its presence is detected by said sensing means;

wherein said second end of said arm further includes a blocking portion, said blocking portion after a ball has entered said ball receipt portion while said arm is in its first upright position, blocking further balls from passing from said ball delivery means to said ball receipt portion when said arm is in its second down position;

wherein said mat has an aperture defined therein and said tee further includes a vertical portion, said vertical portion having a hollow portion defined therein and a base portion, said vertical portion mounted upright on said base portion and positioned with said vertical portion passing through said aperture in said mat with said base portion disposed under said mat;

wherein said sensing means includes a photoelectric sensor directed upwards within said hollow portion of said vertical portion, said photoelectric sensor embedded in a clear epoxy cushion disposed within said base portion;

electrical leads connecting said photoelectric sensor to said control system, said photoelectric sensor, when sensing light, indicating to said control system the absence of a ball on said tee, and when sensing no light, indicating to said control system the presence of a ball on said tee as said ball, when in position on said tee, blocks light from passing down said hollow portion of said tee to said photoelectric sensor;

wherein said ball storage unit comprises:

a helical track, said helical track having an interior and an exterior and first and second ends;

an outer cylindrical wall disposed around the exterior of said helical track;

an inner cylindrical wall disposed on the interior of said helical track, said inner and outer cylindrical walls spaced apart a distance from one another sufficient for a ball to pass therebetween on said helical track wherein said means for entering balls within said ball storage unit includes a ball tray disposed at the first end of said helical track for the manual entry of balls therein;

wherein said ball delivery means is disposed at the second end of said helical track and positioned to direct balls one at a time into said ball receipt portion of the second end of said arm;

a storage chamber defined in said base of said housing for receipt of said mat during nonuse and transport of said device; and at least one connector interconnecting said mat to said housing when said mat is removed from said storage chamber and disposed for use, said connector providing the positioning of said tee at the location where said arm deposits the ball when in its second down position.

2. The device of claim 1 wherein said mat is detachable from said housing.

3. The device of claim 1 wherein said arm is attached to said shaft by releasable engagement means such that if said arm is inadvertently struck by a golf club, said arm will break free from the device without damage and can be re-engaged to said shaft by engaging it back in place.

4. The device of claim 1 wherein said housing further includes:

four support legs disposed thereunder for supporting said housing when said device is in use;

a pair of wheels disposed at said first end of said housing; and a handle disposed at said second end of said housing, said handle disposed such that if a user lifts said handle, said legs lift off the ground and said device can be moved on said pair of wheels by pulling on said handle.

5. The device of claim 1 further including:

a control panel disposed on said housing, said control panel having means to select actuation modes of said device, said housing having an enlarged manual activation button disposed thereon that can be reached and depressed by the user including by the user using his golf club to depress said manual activation button to cause said control system to deposit a golf ball on said tee by actuation of said arm.

* * * * *